United States Patent [19]

Rockley

[11] Patent Number: 4,608,859

[45] Date of Patent: Sep. 2, 1986

[54] PROCESS AND APPARATUS FOR ANALYZING CUTTING FROM OIL AND GAS WELLS

[75] Inventor: Mark G. Rockley, Stillwater, Okla.

[73] Assignee: Microlytics, Inc., Tillwater, Okla.

[21] Appl. No.: 566,183

[22] Filed: Dec. 28, 1983

[51] Int. Cl.[4] ..... E21B 47/00

[52] U.S. Cl. ..... 73/153; 73/76

[58] Field of Search ..... 73/153, 76, 32 R, 149, 73/433, 38

[56] References Cited

U.S. PATENT DOCUMENTS

| | | | |
|---|---|---|---|
| 2,296,852 | 9/1942 | Horner | 73/38 |
| 2,667,782 | 2/1954 | Shea | 73/149 |
| 3,489,002 | 1/1970 | Thompson | 73/149 |

*Primary Examiner*—Jerry W. Myracle

*Attorney, Agent, or Firm*—Curtis, Morris & Safford

[57] ABSTRACT

A process for analyzing a sample of cuttings from oil or gas wells includes as its first step the determination of the water and light hydrocarbon content of the sample. The sample may then be sieved to remove any powders which may affect subsequent steps. The sample is also sieved to separate it into medium and large size fragments which are then weighed. A medium sized fragment is ground, mixed with potassium bromide (KBr) and tested with a Fourier transform infra red spectrometer to determine its mineral content. The larger size fragments are heated in an oven to burn off their volatiles and reweighed to determine their heavy hydrocarbon content. The large size fragments may now be tested with a helium pycnometer to determine the grain density of the sample, a second pycnometer, which uses a clay suspension as the working fluid, to determine the bulk density and porosity of the sample and a permeameter to determine the permeability of the sample. A conventional porosimeter may be used if a pore spectrum of the cutting is desired.

8 Claims, 9 Drawing Figures

CUTTINGS
HOT PLATE
% WATER
% LOW MW HC
SIEVE
POWDER
COARSE + MEDIUM GRAINS
SIEVE
COARSE GRAINS
MEDIUM GRAINS
MINERAL ANALYSIS
250°C OVEN
% HIGH MW HC
HELIUM PYCNOMETER GRAIN DENSITY
POROSIMETER PORE SPECTRUM
CLAY PYCNOMETER BULK DENSITY
POROSITY
PERMEAMETER PERMEABILITY
FLOW OF SAMPLES
FLOW OF DATA

PROCESS AND APPARATUS FOR ANALYZING CUTTING FROM OIL AND GAS WELLS

BACKGROUND OF THE INVENTION

Field of the Invention

The present invention relates to a method and apparatus for detecting the presence of subterranean accumulations of hydrocarbons and is more particularly concerned with a method and apparatus used to carry out the method of analysis of cuttings or cores from drill holes for the purpose of determining the proximity of oil or gas producing formations.

It is commonly known in the geochemical field that the adsorptive power of various soil samples will affect the amounts of entrained gas or oil. It is also known in the field that the relative amount of hydrocarbons present in samples of cores collected in drilling oil and gas wells is an indication of the proximity of accumulations of hydrocarbons to the points from which the samples of earth were obtained.

Because certain rock formations can hold and adsorb hydrocarbons better than others, it is a general practice to analyze the core samples for their mineral contents. Several other important measurements are made on the samples, such as the determination of the permeability, porosity and density of core samples taken from various depths. These measurements yield significant information for the geologist. For example, the porosity of the formation is related to the amount of gas or oil contained in the formation. The measurement of permeability is an indication of the producability of the trapped gas or oil.

The permeability, porosity and density of the core samples, coupled with the water and hydrocarbon content of the samples and an analysis of their mineral content will determine the fluids expected to be produced from the oil well, the possible rate of production and the total amount which will ultimately be produced.

OBJECTS OF THE INVENTION

An object of the present invention is to provide an improved method for analyzing cuttings and fragments of core samples taken from oil or gas wells and apparatus for implementing the method.

It is another object of the present invention to describe a method and apparatus for analyzing oil and gas well cuttings which provides more accurate results than conventionally known methods and devices.

It is a further object of the present invention to provide a method which can analyze relatively small quantities of cuttings and fragments of core samples in batch in a relatively short period of time.

It is a still further object of the present invention to disclose improvements in various known devices used to analyze cuttings and fragments of core samples.

It is yet another object of the present invention to provide apparatus which are mechanically simple to operate, accurate in their measurements and inexpensive to manufacture.

SUMMARY OF THE INVENTION

In accordance with the process of the present invention, a sample is taken from an oil or gas well cutting and tested with a device to determine its water and lightweight hydrocarbon content. Depending on its composition, the sample may then be sieved to remove any powders which may affect subsequent steps. At this point in the procedure, it may also be advantageous to separate the sample by sieving into medium and large size fragments.

A medium size fragment of the sample is ground to a mean particle size of less than about 5 um and mixed with potassium bromide (KBr). The mixture is subjected to a high pressure pellet press whereby a translucent KBr pellet of the composition is formed. The pellet is subjected to an FTIR (Fourier transform infrared) spectroscopic analysis which yields the complete mineral content of the sample.

The large size fragments of the sample remaining after separating out the powders are placed in a 250° C. vacuum oven to remove all of the volatiles. The difference in the weight of the fragments before and after they are placed in the oven determines the heavy hydrocarbon content of the sample.

After the heavy hydrocarbons have been removed from the large size fragments, part of the fragments may be tested with a helium pycnometer to determine the grain density of the sample. If a pore spectrum of this sample is desired, a conventional porosimeter may be used.

After testing with the helium pycnometer, the same fragment tested or a different, large size fragment may be tested with a clay pycnometer to determine the bulk density of the sample. The porosity of the sample may be derived from the bulk density and the grain density, which was measured earlier using the helium pycnometer.

Another large size fragment of the sample is tested using a permeameter to determine the permeability of the cutting.

Primarily, four devices constructed in accordance with the present invention are used to analyze the cuttings—a helium pycnometer to measure the grain density of the sample, a clay pycnometer to measure the bulk density, a permeameter to measure the permeability of the sample and a device to measure the water content and lightweight hydrocarbon content of the sample.

The bulk density is being measured by a clay pycnometer using a solid suspension as a working fluid. Clay, mixed with an oil base, is contained in a hardwood (or other soft material) reservoir. An aluminum or other low density metal cylinder having a 6.5 millimeter bore formed centrally therein and extending in its axial direction is forced into the reservoir until the clay is extruded through the bore. The weight of the cylinder containing the clay is then measured. The sample is weighed alone and, after the cylinder is cleaned of any clay, is placed in the bore. The cylinder is then again forced into the reservoir until the bore is entirely filled by the sample and the clay. The cylinder with the clay and the sample contained in its bore is again weighed. From this information the weight of the clay displaced by the sample can be determined. The density of the clay, which can be determined from the volume of the bore and the weight of the clay entirely filling the bore, and the weight of the clay displaced by the sample will yield the volume of the sample. The volume of the sample and its weight, which was measured earlier, will determine the bulk density of the sample.

To measure the grain density of the sample, a modified Boyle's law pycnometer is used with helium as the working gas. A typical Boyle's law pycnometer includes a first cell which contains the sample and a second cell which is used as the expansion cell. It has been found that the pycnometer is most sensitive when the volume of the two cells are equal and when the volume of the first cell closely approximates the grain volume of the sample.

Because only very small samples are used for testing in accordance with the process of the present invention, there is no need for a separate and distinct first cell found in a typical pycnometer. Rather, it has been found to be advantageous to use the second cell not only for expansion but also as the sample containing cell and to eliminate the first cell. The volume defined by the conduits and pressure transducer of the pycnometer is sufficient for expansion into the second, sample containing cell. In addition, sample cells of different volumes can be interchangeably used to accommodate samples of different sizes. In this way, a sample cell can be selected which has a volume closely matching that defined by the conduits of the device and the grain volume of the sample.

According to the present invention, a permeameter is used to determine the permeability of the sample. The sample is encased in an epoxy resin pill which is drilled on its top and bottom surfaces through to the sample. The epoxy pill is then placed on an O-ring of a cylindrical vacuum device having a central bore. Air is drawn through the sample by a vacuum pump with the pressure in the cylindrical bore measured by a transducer. The transducer is connected to an analog-to-digital converter which is coupled to a microprocessor or a micro-computer. Using Darcy's law, a least squares approximation of the pressure measurements yields the permeability of the sample.

The process also uses a device to measure the water and hydrocarbon content of the sample. A cylindrical container is placed upright on a hotplate heated to 105° C. The sample to be tested is placed in the cylinder and situated between a supporting metal grid and a fabric seal. Nitrogen gas is fed into the cylinder below the sample and forced to flow around the sample upwardly through the cylinder. The cylinder also contains a plurality of molecular sieves positioned above the sample. The length of the cylinder is such that the temperature varies from 105° C. at its lowermost part where the sample resides to 80° C. over the portion of the cylinder where the sieves are positioned. The sample is maintained at a temperature which causes the water and light hydrocarbons to vaporize. The vapors are carried by the dry, nitrogen gas to the sieves. The sieves are chosen with a molecular pore size which allows selective adsorption of the water molecules from the vapors carried by the nitrogen gas. Because the sieves act as a drying agent with a selective pore size, they absorb the water molecules but allow the light hydrocarbon molecules to pass freely therethrough. The weight of the sieves before and after the test determines the water content of the sample. Measuring the weight of the sample before and after it is subjected to drying in this device will yield the total weight of the water and light hydrocarbons vaporized from which the weight of the light hydrocarbons alone may be determined.

The above and other objects, features and advantages of this invention will be apparent in the following detailed description of the illustrative embodiments thereof, which are to be read in connection with the accompanying drawings.

DETAILED DESCRIPTION OF THE PREFERRED EMBODIMENTS

Figure 1:
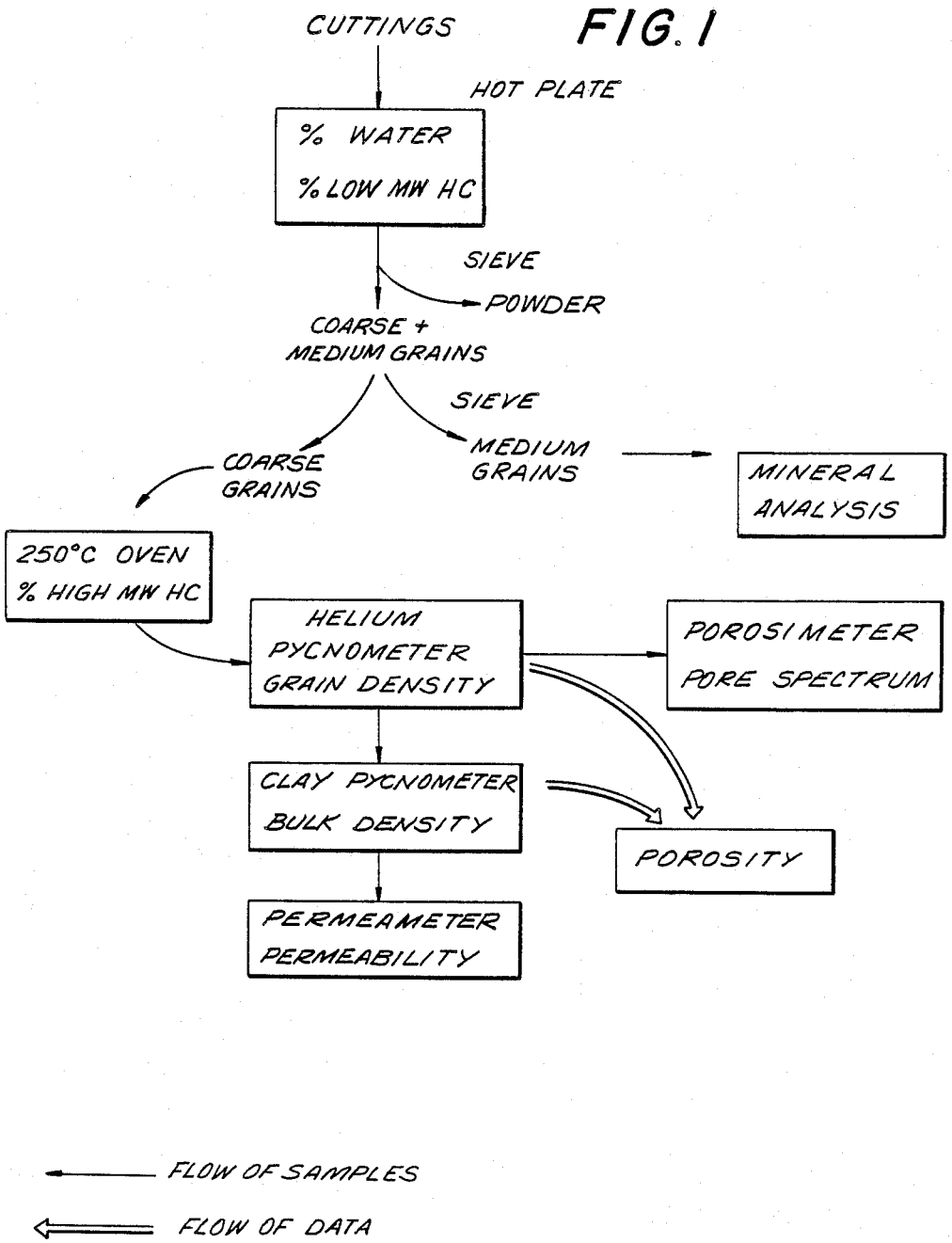
FIG. 1 is a flow chart of the process in accordance with the present invention.

In describing the process and the apparatus used for carrying out the process, reference should be made to the flow chart of the process shown in FIG. 1 of the drawings. In accordance with the process of the present invention, a sample is taken of a cutting from an oil or gas well. The sample is placed in a moisture and gas impervious vial so that it retains its constituent elements during transportation to the laboratory. The sample is first tested to determine its water and light hydrocarbon content.

Figure 2:
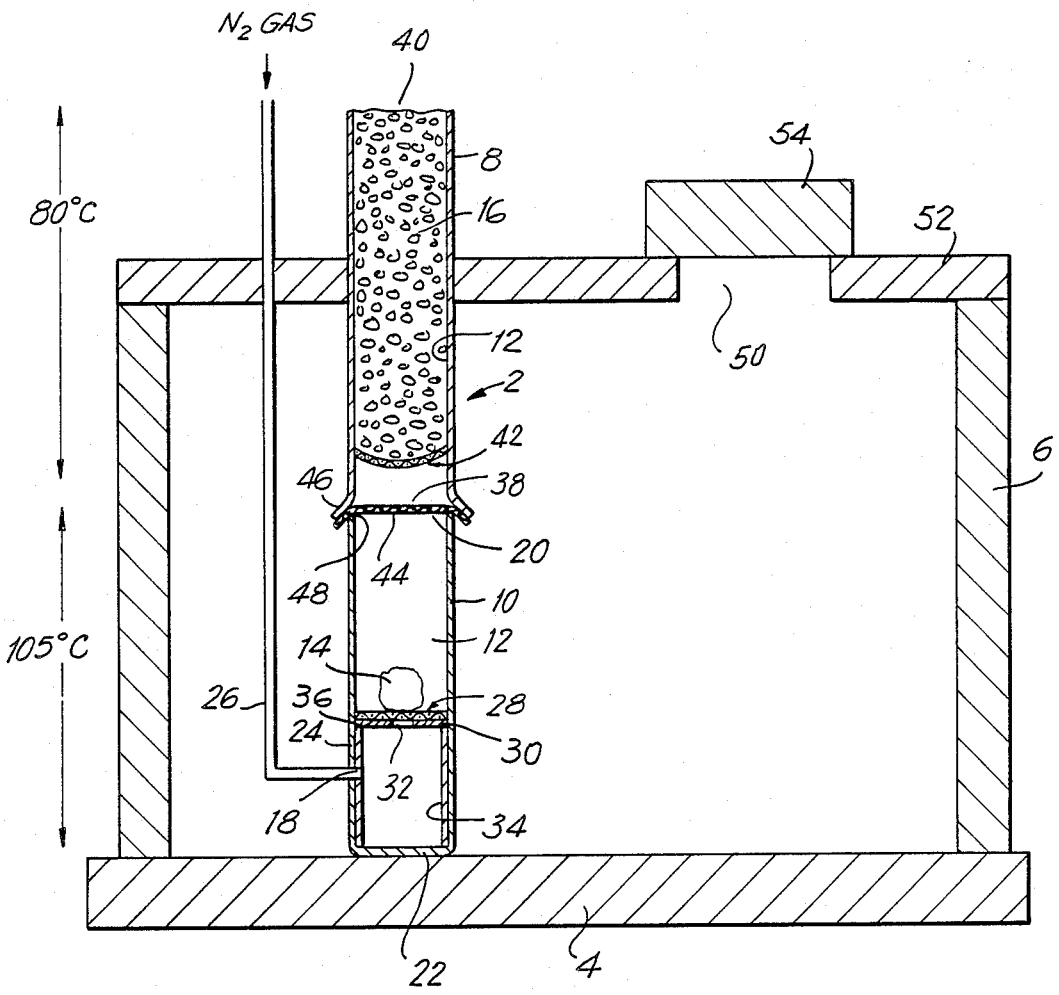
FIG. 2 is a diagrammatic sectional view of a device constructed in accordance with the present invention to measure the water and low molecular weight hydrocarbon content of a core sample.

The device used in the process to measure the water and light hydrocarbon content of the sample is shown in FIG. 2 of the drawings.

To better appreciate the device, it is necessary to explain at this time the particular steps in measuring these two quantities. It has been found that if the sample is heated to a predetermined temperature for a sufficient length of time, the water and light hydrocarbon molecules contained therein will be volatilized. Once they are in the gaseous phase, it is possible to separate these compounds. The difference in the weight of the sample before and after it is heated and dried will equal the combined weight of the water and light hydrocarbon molecules contained in the sample. If in the gaseous phase either one of the compounds can be separated from the other and captured so that its specific weight can be measured, the weight of the other compound can also be determined knowing the combined weight of the two compounds. In other words, the test provides two equations and two unknowns from which the water and light hydrocarbon content of the sample can be determined.

According to the process of the present invention, the sample of the cutting is first weighed. It is then heated to a temperature sufficient to cause the water molecules and light hydrocarbon molecules contained therein to volatilize. The water vapor and hydrocarbon gas given off by the heated sample is passed through a water adsorptive drying agent. This drying agent filters out and adsorbs only the water molecules, allowing the light hydrocarbon molecules to pass freely therethrough. The weight of the drying agent is measured before and after it adsorbs the water vapor. The sample is also reweighed after it is heated and after all the water and light hydrocarbon molecules have volatilized.

The difference between the initial and final weight of the drying agent equals the weight of the water contained in the sample. The weight loss of the sample after it is heated equals the combined weight of the water and light hydrocarbons found therein. One can derive the weight of the light hydrocarbons found in the sample by subtracting the weight gain of the drying agent from the change in weight of the sample before and after it is dried by heating.

It has been found that type 3A molecular sieves serve as an excellent water adsorbent drying agent. Other drying agents adsorb the light hydrocarbons as well as the water with the result that the gain in weight of the drying agent may not truly reflect the water content of the sample, i.e., some of the weight gain may be attributable to the light hydrocarbons. With type 3A molecular sieves, the pores are small enough to exclude all molecules but water.

It is also important that the sample be heated at the correct temperature. This has been found to be about 105° to 110° C. If the temperature is too high, the higher molecular weight hydrocarbons will be volatilized and condense on the sieves, thus affecting the accuracy of the measurement. Usually, heating the sample for about one hour should be sufficient to volatilize the water and light hydrocarbons. If the sample is very powdery, it may be necessary to dry the sample for a longer period of time, such as, two hours.

To ensure that the molecular sieves do not lose water, they should be maintained at a temperature of about 80° to 85° C. The water vapor from the heated sample will condense in the pores of the molecular sieves and be adsorbed thereby.

Because the sample and the molecular sieves should be separately maintained at different temperatures, it is necessary to transport the volatilized light hydrocarbons and water from the heated sample to the molecular sieves. An inert, dry gas, preferably nitrogen, $N_2$, is used for this purpose. The nitrogen should flow over the heated sample and carry the light hydrocarbons and water vapor evolved from the sample to the molecular sieves positioned downstream from the sample.

It is also advantageous if an excess of molecular sieves are used so that any water that might be removed from the sieves which are near the heated sample will be adsorbed by those sieves further downstream.

The device shown in FIG. 2 of the drawings can be used to implement all of the steps described above.

The device comprises a hollow main body portion 2 which is preferably cylindrically shaped. It is positioned upright above a heating element, such as a hot plate 4 or the like, which is maintained at a temperature of about 105° C. As will be described in more detail later, the device may be partially encased in a hardwood (or other thermally transmissive material) casing 6 which more uniformly maintains a lower temperature at the upper portion of the device.

The main body portion 2 includes an upper segment 8 and a lower segment 10 which are detachably fitted together. Each segment 8, 10 has a central bore 12 formed therein and extending axially therethrough. The lower segment 10 thus defines a chamber into which the sample 14 is placed. The upper segment 8 also defines a chamber which holds the molecular sieves 16.

The lower segment 10 includes inlet and outlet ports, 18 and 20 respectively, formed at opposite end portions thereof to allow a carrier gas, such as nitrogen, to pass through the central bore 12 formed therein. Preferably, the lower end 22 of the lower segment 10 is closed. The inlet port 18 of the lower segment is formed in the cylindrical side wall 24 of the lower segment and positioned below the sample 14. To facilitate connection to a source of gas, the inlet port 18 may be connected to a conduit 26 extending from the side wall 24.

The lower segment 10 also includes means for supporting the sample within the lower segment. The sample supporting means can be a fabric or metal mesh screen 28 or the like positioned between the inlet port 18 and the sample 14. The sample may rest on this screen. The screen 28 is, of course, gas permeable to allow the nitrogen gas to flow therethrough and to provide sufficient support for the sample 14.

An apertured disk 30, such as a metal washer or the like having a central hole 32 formed therein, may be positioned below the fabric screen 28. The apertured disk 30 not only supports the fabric screen but also directs the nitrogen gas through its central hole 32 to flow over the sample 14 contained in the lower segment 10 of the device.

The sample supporting means further includes a cylindrical supporting frame 34 which is concentrically disposed within the lower segment 10. The frame 34 has an exposed end 36 which defines a ledge to support the apertured disk 30.

In order to distribute the heat evenly throughout the lower segment 10 which defines the sample chamber, it is preferred if the lower segment is made from brass, although other metals or other heat-conductive materials may be suitable.

Like the lower segment, the upper segment 8 of the main body portion 2 also includes inlet and outlet ports, 38 and 40 respectively, formed at opposite end portions thereof which connect with the central bore 12 formed therein. This allows the nitrogen gas to pass through the central bore 12 which defines the chamber for holding the plurality of molecular sieves 16. The molecular sieves 16 are contained within the central bore 12 of the upper segment 8 preferably by a metal screen 42 or the like positioned across the central bore between the inlet port 38 of the upper segment and the molecular sieves 16.

The upper segment 8 is preferably made from tempered glass or the like or other insulating material. Unlike the side walls 24 of the lower segment 10 which are designed to conduct heat from the hot plate 4 and distribute the heat to where the sample is being supported, the tempered glass of the upper segment 8 helps maintain the molecular sieves 16 at a lower temperature, preferably 80° to 85° C.

As was previously mentioned, the lower and upper segments 10, 8 of the main body portion 2 are detachably fitted together. Between the mating portions of each a seal 44 may be interposed which is preferably made from a finely, woven textile material. The fabric seal 44 allows passage of the nitrogen gas therethrough but not fine powders from the sample 14.

So that the lower and upper segments 10, 8 may be joined together without leakage, the lower end 46 of the upper segment 8 is widened so that the upper end 48 of the lower segment 10 can be telescopically received thereby. Of course, the thickness of the fabric seal 44 interposed between the two segments should be taken into consideration in forming the widened portion of the upper segment.

As mentioned earlier, a hardwood casing 6 may be used in conjunction with the heating element which is preferably a hot plate 4. The hot plate 4 is maintained at a temperature of about 105° to 110° C. Resting on the hot plate 4 is the hardwood casing 6. The casing 6 has a single hole or a plurality of holes 50 formed in its top surface 52. Each hole 50 is dimensioned to receive one of the devices described above, if it is desirable to measure the water and light hydrocarbon contents of several samples in batch. The holes 50 not used can be covered with hardwood blocks 54 to maintain the temperature within the casing 6. The device is partially encased in the casing 6 with a portion of the upper segment 8 protruding from a respective hole 50 in the top surface 52 of the casing. The casing is preferably made from hardwood or like material because it has been found that the hardwood transmits the heat slowly from the hot plate 4 but still well enough that the top surface 52 of the casing, which is level with the molecular sieves 16 of the upper segment, is maintained at about 80° to 85° C. while the hot plate itself is regulated at about 105° to 110° C.

The device operates in the following manner to measure the water and light hydrocarbon content of the sample. Initially, the sample is weighed and placed in the lower segment 10 of the device. The sample, lower segment and fabric seal 44 are then weighed. The upper segment 8 containing the plurality of molecular sieves 16 is also weighed and then fitted onto the lower segment. The device is connected to a source of nitrogen gas and placed above a hot plate 4 or other heating element which is maintained at about 105° C. The sample is dried by heating for about one hour although samples containing powders at greater than about 5% by weight may require drying for a longer period of time, such as two hours.

Heating the sample causes the water and light hydrocarbon molecules contained therein to be volatilized. The heavy hydrocarbons are still retained by the sample. The nitrogen gas which flows into the inlet port 18 of the lower segment 10 and through the apertured disk 30 passes through the central bore 12 of the lower segment where the sample is contained and carries the volatilized water and light hydrocarbon molecules from the lower segment to the upper segment 8 where they contact the molecular sieves 16.

The molecular sieves 16 in the upper segment filter the water molecules from the light hydrocarbon molecules. Because the sieves are maintained at a lower temperature, the water molecules condense in the pores of the molecular sieves and are adsorbed thereby. The lightweight hydrocarbon molecules are passed through the sieves and exit the outlet port 40 of the upper segment 8.

After the sample has been dried by heating for a long enough period to ensure that all the water and light hydrocarbon molecules have been volatilized, the device is removed from the heating element and the two segments are separated. The lower segment 10, containing the sample, and the fabric seal 44 are reweighed as one unit. The upper segment 8 containing the molecular sieves 16 are also reweighed. The difference in the weight of the sample before and after heating equals the combined weight of the water and light hydrocarbon molecules which were contained in the sample. The gain in weight of the molecular sieves corresponds to the water molecules volatilized from the sample and adsorbed by the sieves. The difference between these two measurements, i.e., subtracting the gain in weight of the sieves from the loss in weight of the sample, yields the weight of the light hydrocarbon molecules which were contained in the sample. From the initial weight of the sample alone, the percent weight of the water and light hydrocarbon content of the sample can be calculated.

This procedure to measure the water and lightweight hydrocarbon content of the sample is both simple and inexpensive. The device used to measure these quantities can be easily fabricated and yields accurate results.

This method should be contrasted to microwave drying which is currently being used in the geochemical field to measure these quantities. Microwave drying has several disadvantages. One of the disadvantages is that it is difficult to control the temperature within the sample, which may easily rise above 105° C. As explained earlier, it is undesirable to overheat the sample because the heavy hydrocarbon molecules contained in the sample may also be volatilized, affecting the accuracy of the measurement. Furthermore, although testing a sample using the microwave drying method works satisfactorily in many applications, it is no faster than the process of the present invention and requires more expensive equipment.

The procedure and the device of the present invention described above is particularly well suited for testing samples in batch. The test is simple to perform and yields accurate results in a short period of time. The size of the sample need not be more than 2 cubic centimeters. The equipment is inexpensive to build and operate and it is envisioned that it can be partially automated to measure the water and light hydrocarbon content of the sample. The type 3A molecular sieves adsorb only the water molecules for a more accurate measurement. Furthermore, they can be regenerated for use in subsequent tests.

The next step in the process is a sieving operation, as shown in the flow chart of FIG. 1 of the drawings. The same sample which was tested for its water and light hydrocarbon content is sieved to separate it into medium size and coarse size fragments.

The sample is placed on a sieve having about 0.5 millimeter diameter holes. The fine powders of the sample passing through this sieve are weighed and then discarded. The reason for discarding these powders is that they may adversely affect the accuracy of subsequent measurements. It should be noted here that the sieving operation is not done before the water and hydrocarbon content test. The reason is that the fine powders of the sample may contain an excess of water or light hydrocarbons by selective adsorption from the larger chips and thus must be included in the test described previously.

After the sample has been sieved to separate out the fine powders, it is again sieved using a screen having about 1.5 millimeter diameter holes. This step separates the medium size grains from the coarse size grains. The medium and coarse size grains of the sample separated by the sieving operation will be used for respective tests in the procedure. The weights of the medium and coarse size fragments are recorded.

As shown in the flow chart of the process, the coarse grained fragments are placed in a vacuum oven at a temperature of about 250° to 275° C. for about 60 minutes. The fragments are then removed from the oven and reweighed. The purpose of heating the fragments to this temperature under a vacuum of less than about 1 torr is to remove all of the heavy hydrocarbons which have significant vapor pressure from the sample.

Because the same sample was tested earlier in the process for its water and lightweight hydrocarbon content, these constituents have been previously removed. Therefore, only the heavy hydrocarbons are removed by heating the sample in the oven. The loss of weight of the coarse fragments heated by the oven is attributable to the volatilization of the heavy hydrocarbons contained therein. The loss in weight divided by the initial weight (before heating in the oven) of the coarse fragments multiplied by 100 yields the heavy hydrocarbon content of the sample expressed as a percentage. This value can be added to that previously determined for the light hydrocarbon to derive the total hydrocarbon content of the sample expressed as a percentage.

As stated previously, the oven is maintained at a temperature of between 250° to 275° C. It is also placed under a partial vacuum at a pressure of between 10 torr and 15 microns, depending on the amount of volatile materials contained in the sample. For small size samples, most of the volatiles are removed within 15 minutes under these conditions. By monitoring the partial pressure in the oven, it can be determined when substantially all of the heavy hydrocarbons have been removed. In actual tests, after 15 minutes under the conditions described above, the pressure in the oven was estimated to be about 1 torr or less.

Heating the sample at about 250° C. in vacuo for up to 60 minutes will remove all but the very least volatile materials. The heavier materials which are not removed may constitute a small error. This error can be removed by appropriate solvent extraction which is a commonly known practice and will not be described herein. Because this process is well adapted to testing cuttings in batch, solvent extraction is not performed here because it would introduce a substantial increase in the average time to analyze the samples.

After all of the volatile materials have been removed, the coarse grained fragments of the sample are divided into several fractions for further testing in accordance with the process of the present invention. One of the fractions is now tested with a helium pycnometer, constructed in accordance with the present invention, to determine the grain density of the cutting.

Figure 3:
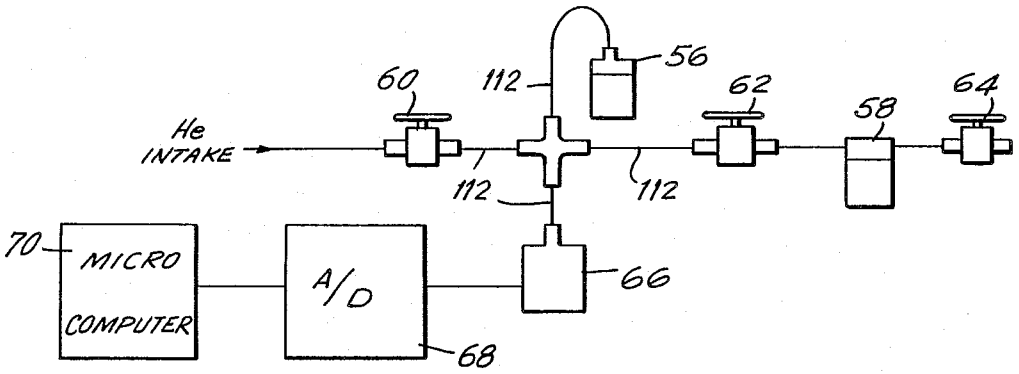
FIG. 3 is a diagrammatic representation of the helium pycnometer constructed in accordance with the present invention.

The helium pycnometer of the present invention is shown in FIG. 3 of the drawings. It comprises basically an auxiliary chamber 56 and a sample chamber 58 which as its name implies contains the sample to be tested. The auxiliary chamber 56 is connected through an intake valve 60 to a source of gas, such as helium, under pressure. The auxiliary chamber 56 and the sample chamber 58 are interconnected through an expansion valve 62. The sample chamber 58 may also be connected to a vent valve 64 to return the pressure in the sample chamber after the test to atmospheric. The structures of the chambers will be described in more detail later.

The helium pycnometer also includes a pressure transducer 66 connected to the auxiliary chamber 56 between the intake and the expansion valves 60, 62. The transducer 66 measures the pressure within the auxiliary chamber. Although it is envisioned that the pressure transducer 66 may be located between the expansion and vent valves 62, 64 to monitor the pressure within the sample chamber 58, it is more preferred to locate the transducer as described previously. By locating the pressure transducer 66 upstream from where the sample is located, any dust or particles given off by the sample will not contaminate the pressure transducer and affect its reading.

The preferred pressure transducer 66 is the capacitance type commonly known and used in the field today. A suitable transducer is Model Number 205-2 built by Setra Systems, Inc., which has a stated accuracy of 0.1% over its entire usable range. The transducer should have a range up to 25 pounds per square inch. As is well known in the art, capacitance transducers are among the most accurate and convenient to use in the field today. The transducer generates an output signal as a voltage which varies in accordance with the pressure in the auxiliary chamber.

Responsive to the output signal from the capacitance transducer 66 is an analog-to-digital converter (A/D) 68. A twelve bit A/D converter 68 will provide the resolution required for this test. The zero to 25 psia range of the pressure transducer 66 can be divided into 4095 data bits by the A/D converter. Stated another way, a change of one bit in the digital output of the A/D converter 68 corresponds to a change of 6105 millibars of pressure.

The output of the A/D converter 68, which is a binary or similar code corresponding to the output voltage signal from the pressure transducer 66, is connected to a mini-computer 70 or microprocessor to process and store the pressure data. Of course, it is envisioned that the A/D converter and the mini-computer could be replaced by an appropriate digital voltmeter or the like.

As with any typical Boyle's law pycnometer, it is necessary to pressurize one of the chambers and expand into the other. The helium pycnometer of the present invention is preferably operated by pressurizing the auxiliary chamber 56 and expanding into the sample chamber 58.

The following procedure may be used to operate the device. The sample is first sealed in the sample chamber 58. The vent valve 64 and the expansion valve 62 are opened so that each of the sample and auxiliary chambers are at atmospheric pressure, $P_a$. The vent and expansion valves are then closed and the intake valve 60 to the source of compressed helium gas is opened. The auxiliary chamber is raised to an initial absolute pressure of $P_1+P_a$. The intake valve 60 is then closed. The expansion valve 62 is opened to allow the helium gas in the auxiliary chamber 56 to expand into the sample chamber 58 so that the pressure in both chambers equalize at $P_2+P_a$.

At this point in the description, it is advantageous to show the derivation of the operating equation for the helium pycnometer.

It is well known that the number of mols in the chambers before expansion will equal the number of mols in the chambers after expansion. Thus, $$n_1+n_2=n_3+n_4 \qquad \text{(Eq. 1)}$$

where $n_1$, $n_2$ respectively equal the number of mols of gas in the auxiliary and sample chambers before expansion and $n_3$, $n_4$ respectively equal the number of mols of gas in the auxiliary and sample chambers after expansion.

Because the pressures under which the helium pycnometer of the present invention is operating are relatively low, i.e., less than 25 psig, the helium behaves as an ideal gas. Thus, the ideal gas law, $$pV=nRT \quad \text{(Eq. 2)}$$

where p=pressure of a gas
V=volume of a gas
n=number of mols of a gas
R=The ideal gas constant
T=temperature is applicable.

Therefore, assuming an isothermal expansion of a perfect gas, the following can be derived from Equations 1 and 2:

$$\frac{(p_1+p_a)V_a}{RT}+\frac{p_a(V_s-V_g)}{RT}=\frac{(p_2+p_a)V_a}{RT}+\frac{(p_2+p_a)(V_s-V_g)}{RT} \quad \text{(Eq. 3)}$$

where $p_1$, $p_2$=the pressures measured by the transducer before and after expansion,
$V_a$, $V_s$=the volumes of the auxiliary and sample chambers respectively, and
$V_g$=the grain volume of the coarse sample.

From the above, the following operating equation for the helium pycnometer can be derived:

$$V_g=V_s-V_a\left(\frac{P_1}{P_2}-1\right) \quad \text{(Eq. 4)}$$

To calibrate the helium pycnometer of the present invention to determine the exact volumes of the auxiliary chamber 56 and the sample chamber 58, steel balls having a known volume are used. Without a sample in the sample chamber 58, the pressure in the auxiliary chamber 56 is raised and measured by the pressure transducer 66 as $P_1$ (above atmospheric pressure). The gas in the auxiliary chamber 56 is expanded into the sample chamber 58 by opening the expansion valve 62 and pressure $P_2$ is measured after expansion. Steel balls having a known volume are then placed in the sample chamber and the test is repeated yielding $P_1'$ and $P_2'$ pressure measurements which correspond respectively to the pressures in the auxiliary chamber before and after expansion into the sample chamber containing the steel balls.

Because in the first part of the calibration test no sample is placed in the sample chamber, $V_g=0$. From this, the operating equation (Equation 4) can be rearranged as follows:

$$(P_1/P_2-1)\times V_a=V_s. \quad \text{(Eq. 5)}$$

Because the volume of the steel balls is known and their pore volumes are negligible, the equation for the second part of the calibration test becomes:

$$(P_1'/P_2'-1)\times V_a=V_s-V_{spheres}, \quad \text{(Eq. 6)}$$

where, as mentioned previously, $P_1'$ and $P_2'$ are the gauge pressures before and after expansion into the sample chamber containing the steel balls.

Thus, the following proportion may be derived:

$$\frac{P_1/P_2-1}{P_1'/P_2'-1}=\frac{V_s}{V_s-V_{spheres}} \quad \text{(Eq. 7)}$$

Because $V_a$ is found on both sides of Equation 7, it cancels out from the proportion.

By measuring $P_1$, $P_2$, $P_1'$ and $P_2'$ in a calibration test, the exact volumes of the auxiliary and sample chambers can be calculated.

The following example is given of a calibration test on the helium pycnometer constructed in accordance with the present invention.

Three one-quarter inch steel balls were used having a total volume equal to 0.402 cubic centimeters.

Running both parts of the calibration test yielded the following digital data from the A/D converter:

$$P_1=2274,\ P_2=875,\ P_1'=2274,\ P_2'=970$$

Substituting these measurements into the proportion shown in Equation 7 above, it is evident that:

$$\frac{1.5989}{1.3443}=\frac{V_s}{V_s-.402}$$

$$\frac{1.3443}{1.5989}=1-\frac{.402}{V_s}$$

$$.8408=1-\frac{.402}{V_s}$$

$$.1592=.402/V_s$$

$$V_s=2.525 \text{ cc}$$

$$\text{Therefore, } V_a=\frac{2.5251}{1.5989}=1.5793 \text{ cc}$$

With the volumes of the auxiliary and sample chambers known, the operating equation for the helium pycnometer becomes:

$$V_g=2.5251-1.5793\,(P_1/P_2-1) \text{ cc} \quad \text{(Eq. 8)}$$

The calibration of the two volumes may be checked using spheres of known volumes. The following example is given for such a test using the helium pycnometer calibrated in the example above.

Steel balls having a known combined volume of 0.626 cc were placed in the sample chamber. The measured pressures before and after expansion, i.e., $P_1$ and $P_2$, were 2274 and 1033 respectively, expressed in their digital equivalent of the A/D converter's output. Using Equation 8 above yielded a volume for the steel balls of 0.628 cc, which is 0.002 away from the known volume. If the pressure after expansion, $P_2$, happened to be 1034, from our equation the volume of the spheres would be calculated to be 0.631 cc. This yields an error of 0.5% on 600 ul for an error of one digit of the A/D converter's output reading.

Thus, the operating equation, Equation 8 shown above, yields the grain volume of the coarse sample tested. Knowing the weight of the coarse sample after it was removed from the oven, the grain density of the cutting can be measured from the following equation:

$$G_d=w/V_g \quad \text{(Eq. 9)}$$

where $G_d$=the grain density of the cutting,
w=the weight of the sample, and $V_g$=the grain volume of the sample.

An example of this calculation for a cutting sample is shown below using the helium pycnometer calibrated in the test described above. A sample from a cutting taken from a depth of between 1350 and 1360 feet, when tested in the helium pycnometer of the present invention, yielded the following measurements expressed as a digital equivalent of the A/D converter's output: $P_1=2278$ and $P_2=1126$. Substituting these measurements into the operating equation, Equation 8, the grain volume of the sample was determined to be 0.909 cc. The weight of the sample was measured to be 2.444 grams. From Equation 9, the grain density of the sample was determined to be 2.688 g/cc.

Although the capacitance transducer selected to be used with the helium pycnometer of the present invention has a stated accuracy of 0.1% over its 0 to 25 pounds per square inch operating range, to improve the reliability of the pycnometer it is preferable to run the tests at pressures which remain within 10% of the pressures used for calibration. This will, of course, minimize any errors.

Taking into account the actual performance of the equipment used which may lead to errors in the measurements, it has been found that the pressure transducer 66 in actual use may be less accurate than its stated theoretical accuracy. To overcome this problem, it has been found that keeping the pressure transducer under pressure near the measured pressures provides a more accurate reading. This effectively "prestresses" the transducer.

To improve the accuracy of the pressure transducer by the prestress method, the helium pycnometer may be operated in the following manner. The sample is sealed in the auxiliary chamber 56 and the expansion and vent valves 62, 64 are opened to equalize the pressures in the sample and auxiliary chambers 58, 56 at atmospheric. The vent and expansion valves are then closed and the intake valve 60 is opened to allow helium gas to pressurize the auxiliary chamber 56 to about 17 psig. The intake valve is closed and the expansion valve 62 is opened to allow the gas from the auxiliary chamber 56 to expand into the sample chamber 58. The expansion valve is closed and the sample chamber is vented by way of the vent valve 64. After closing the vent valve, the auxiliary chamber is repressurized to about 17 psig. After the intake valve is closed and after allowing enough time for the pressure transducer 66 to relax, a reading from the A/D converter 68 is taken. The expansion valve 62 is then opened and a second pressure measurement is taken. Allowing the pressure transducer to relax in the vicinity of the measured pressure rather than at 0 psig between expansions provides a more accurate measurement of the grain volume. This technique may be referred to as the double expansion method.

The helium pycnometer of the present invention differs from conventional pycnometers in many respects. It has been found that the helium pycnometer of the present invention is most sensitive when the volume of the sample chamber 58 matches as closely as possible the estimated grain volume of the sample being tested. It is, therefore, advantageous to "tune" the volume of the sample chamber 58 to the estimated grain volume. To accomplish this, the pycnometer is adapted to receive a number of sample chambers of varying volumes so that a sample chamber may be selected for use with a particular size sample.

It has also been found that, when the volume of the sample chamber 58 is much larger than the grain volume of the sample, the pycnometer is most sensitive when the volumes of the auxiliary and sample chambers 56, 58 are equal. Thus, the pycnometer is also adapted to receive different auxiliary chambers of varying volumes.

Of course, when selecting an auxiliary chamber and a sample chamber to use, the volume of the sample chamber will typically never be able to equal the grain volume of the sample and usually will be about twice the grain volume. This is when it is advantageous to match the volumes of the auxiliary and sample chambers to minimize the measurement errors as much as possible. This is especially necessary when the grain volume of the sample is very small. In this case, the dead volumes of the pressure transducer 66 and conduits connecting the various components of the helium pycnometer no longer only negligibly affect the measurements.

Figure 4B:
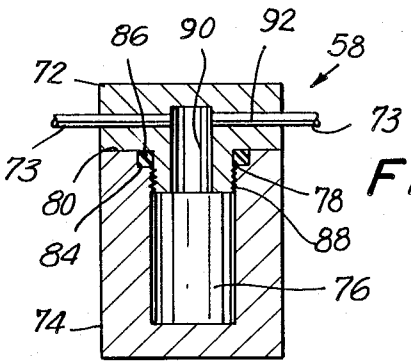
FIGS. 4*a* and 4*b* are sectional views of the sample and auxiliary chambers for the helium pycnometer of the present invention.
Figure 4A:
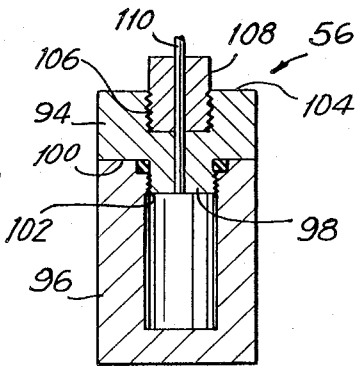

A detailed drawing of each of detachable sample and auxiliary chambers is shown in FIGS. 4*a* and 4*b* respectively.

The sample chamber 58, shown in FIG. 4*a* of the drawings, includes an upper portion 72 connected to conduits 73 of the pycnometer, which are preferably $\frac{1}{8}$" tubing, and a removable lower portion 74. The lower portion 74 is cylindrically shaped and includes a central bore 76 which extends partially therethrough from an opening 78 formed in the upper surface 80 thereof. A portion 82 of the bore 76 is preferably threaded to receive the upper portion 72. The upper surface 80 of the lower portion 74 surrounding the opening 78 formed therein is preferably recessed to form a lip 84 which acts as a seat for an O-ring 86 which encircles the opening 78.

The lower portion 74 of the sample chamber 58 is preferably made of aluminum, although other materials may be suitable. The dimensions are chosen to define a central bore 76 of selected volume.

The upper portion 72 of the sample chamber is also preferably cylindrically shaped and includes a threaded hub 88 which is dimensioned to be received by the threaded portion 82 of the lower portion's bore. A central bore 90 partially extends in the axial direction through the upper portion 72 and connects with a transverse bore 92 extending diametrically through the upper portion. The transverse bore 92 receives conduits 74 which connect to the expansion valve 62 and vent valve 60 of the pycnometer. The upper portion 72 of the sample chamber is preferably made of brass.

The structure of the auxiliary chamber 56 is shown in FIG. 4*b* of the drawings. Like the sample chamber 58, it also includes an upper portion 94 and a removable lower portion 96. The lower portion 96 of the auxiliary chamber 56 is similar in structure to the lower portion 74 of the sample chamber 58 and need not be described herein.

The upper portion 94 of the auxiliary chamber 56 is cylindrically shaped and, like the upper portion 72 of the sample chamber 58, is preferably made of brass. It includes a threaded hub 98 extending from its lower surface 100. The threaded hub 98 is received by the threaded bore 102 of the lower portion 96.

The top surface 104 of the upper portion 94 of the auxiliary chamber is recessed to form a threaded opening 106 to receive a threaded fitting 108 of the conduit 110 connecting the auxiliary chamber 56 to other components of the pycnometer.

Figure 5:
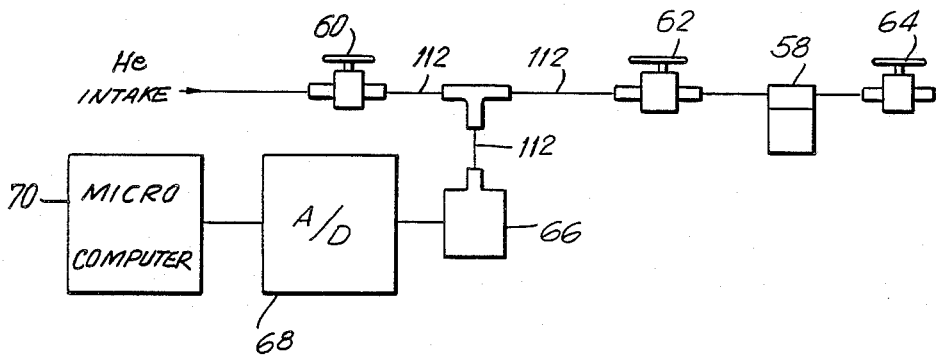
FIG. 5 is a diagrammatic representation of an alternative embodiment of the helium pycnometer of the present invention.

A more preferred, alternative embodiment of the helium pycnometer of the present invention is shown in FIG. 5 of the drawings. It is similar in many respects to the embodiment shown in FIG. 3 except that a separate, identifiable auxiliary chamber has been omitted. Like components of the embodiments shown in FIGS. 3 and 5 are designated with the same reference numerals.

Because the size of the sample tested is relatively small, i.e., 0.6 to 1 cc, it is, as explained previously, important to make the volume of the sample chamber 58 as small as possible so that it approaches the grain volume of the sample. Because there are practical limitations to the size of the sample chamber 58 which can be used, it is preferable if the volume of the auxiliary chamber 56 closely approximates that of the sample chamber 58 to provide the helium pycnometer with maximum sensitivity.

Pressure transducers currently on the market today have a dead volume of about 2 cc. To accurately measure the grain density of samples 1 cc in size, the dead volume of the pressure transducer 66 and the volume defined by the conduits 112 connecting the intake valve 60, the expansion valve 62 and the pressure transducer with the auxiliary chamber must be added to the effective total volume of the auxiliary chamber 56.

Because it is advantageous to match as closely as possible the effective volume of the auxiliary chamber 56 with the volume of the sample chamber 58, and because the volume of the sample chamber 58 must be made very small so that it approximates the grain volume of the sample, it has been found advantageous to omit the separate auxiliary chamber 56 and use the dead volume of the pressure transducer 66 and interconnecting conduits 112 as the effective auxiliary chamber. In this way, the combined volume of the transducer and conduits more closely approaches the volume of the sample chamber than if a separate auxiliary chamber were included in the circuit. This embodiment is particularly advantageous when using samples from 0.6 to 1 cc in size.

It has been found that with a separate auxiliary chamber of 4.7 cc and when testing a sample of between 0.6 and 1 cc in size, the error varied between 1 and 1.5%. With the embodiment shown in FIG. 5 of the drawings, the error was reduced to approximately 0.3% for a 0.6 cc sample.

Because the helium pycnometer of the present invention is extremely accurate and more accurate than many conventional Boyle's law pycnometers, the limitations of its accuracy approach the tolerances of the steel balls used to calibrate the system. It may be necessary, therefore, to calibrate the volumes of the sample and auxiliary chambers with a measured amount of mercury which, of course, has a known density.

Figure 6:
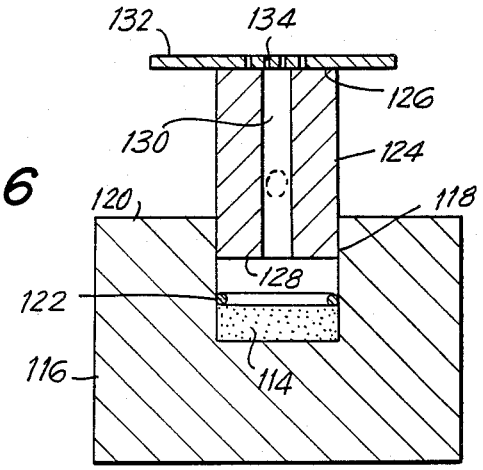
FIG. 6 is a diagrammatic sectional view of a clay pycnometer constructed in accordance with the present invention.

After the grain density of the cutting is determined using the helium pycnometer, the same coarse sample is tested with a clay pycnometer to determine its bulk density. We refer you to FIG. 6 of the drawings which shows a preferred embodiment of the clay pycnometer.

The clay pycnometer of the present invention, which is used to measure the bulk density, uses a solid suspension 114 as a working fluid. The solid suspension 114 is preferably clay with an oil base for adherence, although other suspensions are acceptable as long as they are not solely non-wetting fluids or wetting fluids. A suspension having fine solid particles suspended in a nonvolatile fluid adhering to the solid particles may be used as the working fluid.

The clay pycnometer of the present invention includes a base 116 which has a reservoir 118 formed in the top surface 120 thereof which extends partially therethrough. The base 116 with its reservoir 118 serve to contain the solid suspension 114. The base 116 may also include an O-ring 122 which is positioned within the reservoir at about the surface level of the solid suspension 114 which partially fills the reservoir 118.

The clay pycnometer of the present invention also includes a cylindrical extruder 124 having flat upper and lower surfaces, 126 and 128 respectively. A small diameter bore 130, preferably not greater than 0.25 inches in diameter, extends axially entirely through the cylindrical extruder 124 from the upper surface 126 to the lower surface 128.

The cylindrical extruder 124 preferably has a diameter which is slightly smaller than the diameter of the reservoir 118 of the base 116 so that the cylindrical extruder can be closely received by the reservoir. If an O-ring 122 is used in the reservoir of the base, it should be taken into account when determining the proper diameter for the extruder. When the extruder 124 is forced into the reservoir of the base 116, the O-ring 122 is compressed between the extruder and the walls of the reservoir to provide a fluidtight seal.

The cylindrical extruder 124 is preferably made of aluminum or other non-dense metal. The base 116 is preferably made from a hardwood or plastic or other polymeric material. Hardwood or plastic is preferred because of its strength and because it is not hard enough to scratch the walls of the aluminum cylindrical extruder 124.

Although not absolutely necessary, the clay pycnometer of the present invention may further include a flat plate 132 formed with a plurality of holes 134. This plate 132 is placed on top of the upper end 126 of the cylindrical extruder 124 as it is being forced into the reservoir 118 of the base 116. The plate 132 allows the air to escape from the central bore of the extruder while preventing the sample from being forced out of the bore by the clay. The holes 134 in the plate are preferably about 0.5 millimeters in diameter.

The clay pycnometer of the present invention operates in the following manner to determine the bulk density of the sample. The reservoir 118 of the base 116 is partially filled with the clay suspension 114 up to about the level of the O-ring 122. Before an actual test on a sample is performed, it is necessary to calibrate the clay pycnometer and to determine the density of the solid suspension 114 being used.

The weight of the cylindrical extruder 124 clean of any clay is measured. The extruder is then slowly forced into the reservoir of the base 116 until the clay suspension 114 is extruded into the bore 130 of the cylindrical extruder and fills its entire axial length. The cylindrical extruder filled with clay is then weighed. This measurement is recorded for future calculations and need only be made once for all of the samples being tested.

The length of the cylindrical extruder 124 and the diameter of its bore 130 are formed by machining to close tolerances. From the length and diameter of the bore, the volume of the bore can be determined. The increase in the weight of the cylindrical extruder after it is filled with clay is, of course, solely attributable to the clay entirely filling the bore. According to the formula, $$D = W/V \qquad \text{(Eq. 10)}$$

where

D equals the density of the clay,

W equals the weight of the clay filling the bore of the extruder, and

V equals the volume of the bore, the density of the clay suspension can be calculated. This measurement also need only be made once for all of the samples tested provided that the operating conditions remain the same and that the suspension is homogeneous.

The sample to be tested is initially weighed although this may have been done in a previous step of the process if the same sample tested with the helium pycnometer is used for this test. The extruder 124 is cleaned of any clay 114 from the calibration test and the sample is placed within the central bore 130 of the extruder. The extruder is then again slowly forced into the reservoir 118 of the base 116. The clay will be extruded into the bore of the cylindrical extruder and will surround the sample. To ensure that the clay entirely fills the void space of the bore 130 and completely surrounds the sample, the extruder is removed from the reservoir 118 of the base, turned around lengthwise and forced back into the reservoir with its opposite end so that the clay enters the bore 130 from both sides. This double extrusion step ensures that the sample is closely surrounded by the clay 114.

The cylindrical extruder 124 is removed from the reservoir of the base 116 and is cleaned of any excess clay not occupying the bore 130. Any clay which protrudes from opposite ends of the bore can be removed by shaving the end surfaces 126, 128 of the extruder with a razor blade or other sharp instrument. This last step is critical for accurate measurements. The ends of the extruder must be precisely shaved so that it introduces no more than one mg of error. The cylindrical extruder 124 with the clay suspension 114 and sample completely filling its bore 130 is now weighed.

From this last measurement, the combined weight of the cylindrical extruder 124 and the clay partially filling its central bore 130 can be determined by subtracting the weight of the sample which was measured initially. The weight of the clay displaced by the sample can be determined by subtracting the weight of the extruder partially filled with clay from the weight of the extruder entirely filled with clay, as measured earlier during the calibration portion of the test. The weight of the clay displaced and the density of the clay, which was also calculated during calibration, will yield the volume of the clay displaced. Because the clay closely surrounds the surface of the sample without entering the pores thereof, the volume of the clay displaced will equal the volume of the sample.

Now knowing the volume of the sample and the weight of the sample measured previously, the bulk density of the sample may be derived from the following equation:

$$\text{Bulk Density} = \frac{\text{Sample Weight}}{\text{Sample Volume}} \qquad \text{(Eq. 11)}$$

Because the grain density was determined earlier by testing with the helium pycnometer of the present invention, the porosity of the cutting can be calculated from the following equation:

$$\text{Porosity} = \left(1 - \frac{\text{bulk density}}{\text{grain density}}\right) \times 100\% \qquad \text{(Eq. 12)}$$

Also, the pore volume of the sample may now be determined by subtracting the grain volume, measured earlier with the helium pycnometer, from the bulk volume.

An example of a measurement using the procedure just described is shown below. A sample from a cutting taken from a depth between 825 and 830 feet was tested using the clay pycnometer of the present invention. The weight of the cylindrical extruder 124 with clay completely filling its bore 130 was measured to be 56.482 grams. Knowing the precise length and diameter of the bore 130 allows one to calculate the volume of the bore. From the volume and the weight of the filled extruder given above, the density of the clay suspension was determined to be 1.649 grams/cm$^3$.

The weight of the sample alone was measured to be 0.585 grams. The cylindrical extruder 124 was cleaned of any clay and the sample was placed in its bore 130. The clay suspension 114 was then forced into each end of the bore 130 by the double extrusion method described previously so that it completely filled any space unoccupied by the sample. The weight of the extruder with the clay and the sample was measured to be 56.689 grams. Thus, the weight of the cylindrical extruder partially filled with clay was determined by subtracting 0.585 grams from 56.689 grams, which equals 56.104 grams. The weight of the clay displaced by the sample was calculated by subtracting 56.104 grams from 56.482 grams, which thus equals 0.378 grams. Therefore, the volume of the clay displaced, which equals the volume of the sample, is equal to 0.378 grams divided by 1.639 grams/cm$^3$, or 0.2292 cm$^3$.

By using Equation 11, the bulk density of the sample was measured by dividing 0.2292 cm$^3$ into 0.585 grams, which equals 2.552 grams/cm$^3$.

It was previously determined from testing the sample with the helium pycnometer of the present invention that the grain density of the cutting was 2.722 grams/cm$^3$. Using equation 8, the porosity equals:

$$\left(1 - \frac{2.552}{2.722}\right) \times 100\% = 6.2\%$$

The clay pycnometer of the present invention is simple to operate and inexpensive to construct. Each measurement takes perhaps two minutes. The pycnometer is also extremely accurate; its accuracy is limited only by the balance used to weigh the extruder, sample and the clay suspension.

The clay pycnometer of the present invention has many advantages over conventional pycnometers. Bulk density is conventionally measured by using mercury extrusion pycnometers. That is, mercury is forced under pressure into a sample chamber to surround a sample contained therein. The pressure of the mercury is adjusted so that it does not intrude into the pores of the sample. In many applications however, the mercury does not completely surround the sample unless it has also intruded into the larger pores of the sample.

Advantageously, it has been found that a clay suspension thoroughly surrounds the sample and does not intrude into the more porous samples. It is a better procedure than using conventionally known water methods because it is extremely simple and fast and one does not have the problem of removing water adhering to the surface of the sample without also removing water from the interior of the sample.

The permeability of the cutting is measured with a permeameter constructed and operated in accordance with the present invention.

Figure 7:
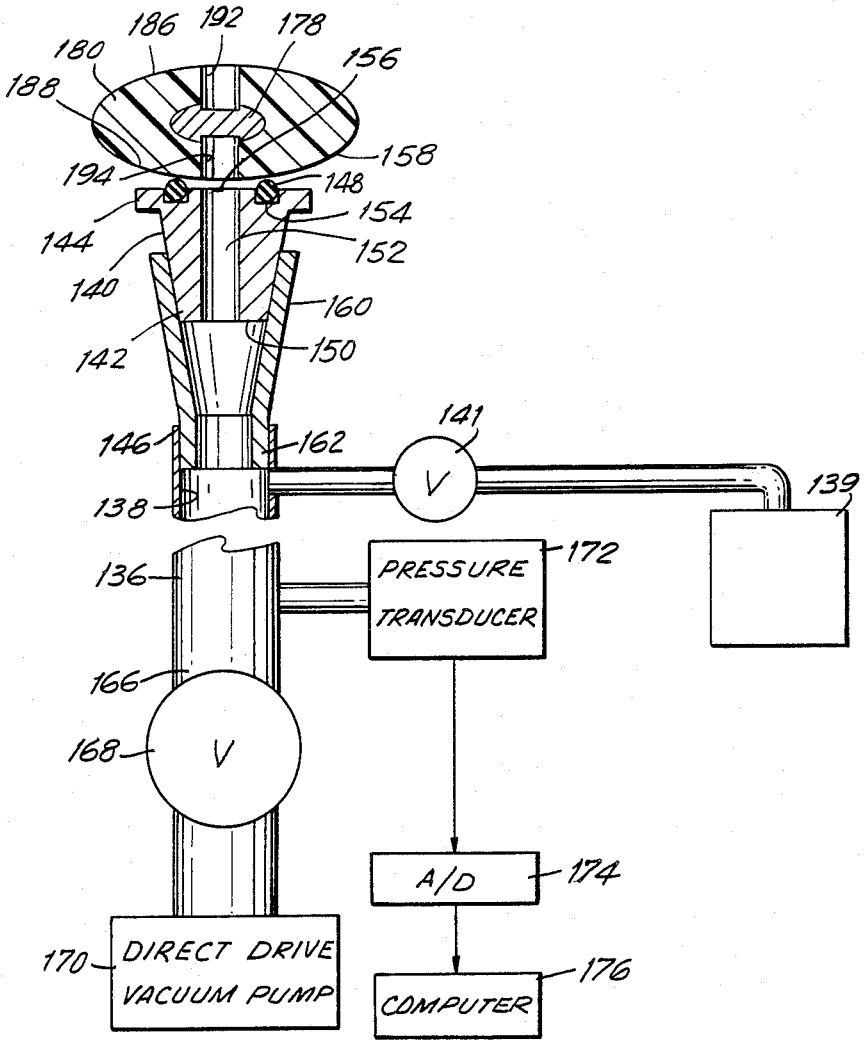
FIG. 7 is a diagrammatic sectional view of a permeameter constructed in accordance with the present invention.

We refer you to FIG. 7 of the drawings which shows the permeameter of the present invention. The permeameter preferably includes a main cylindrical body 136 which is open at both ends and which includes a central bore 138 extending between the opposite ends to allow air to flow through the cylindrical body.

The permeameter also includes a sample support member 140. The sample support member 140 has a basically truncated conical shape with its lower end 142 having a smaller diameter than its upper end 144 so that the lower end 142 can be received by the upper end 146 of the main cylindrical body 136. The sample support member 140 includes an upper surface 148 and a lower surface 150 and a bore 152 which extends centrally between the upper and lower surfaces 148, 150. This bore 152 allows air to pass through the sample support member 140 and into the main cylindrical body 136 of the permeameter. The sample support member 140 may have formed in the top surface 148 thereof a recess 154 which concentrically surrounds the opening 156 in the top surface 148 formed by the central bore 152. The recess 156 acts as a seat for an O-ring 158.

If desired, the permeameter of the present invention may include an extension 160 interposed between the sample support member 140 and the main cylindrical body 136. Like the sample support member, the extension 160 also has a truncated conical shape with its lower end 162 having a smaller diameter than its upper end 164. The lower end 162 of the extension 160 is received by the upper end 146 of the main cylindrical body 136 and the lower end 142 of the sample support member 140 is received by the upper end 164 of the extension 160.

The sample support member 140 and the main cylindrical body 136 or the combination of the sample support member, extension 160 and main cylindrical body are joined together in an air-tight fashion so that they provide a central passage of air extending through the entire axial length of the combined components.

The lower end 166 of the main cylindrical body 136 is connected to a stopcock or valve 168 which in turn is connected to a direct drive vacuum pump 170. The main cylindrical body 136 is also connected to a pressure transducer 172 for measuring the pressure of the air passing through the bore 138 of the main cylindrical body.

The main cylindrical body 138 may also have attached to it one or more large auxiliary volumes 139 isolated from the main body 138 by stopcock or valve 141 such that the overall volume of the permeameter is increased. This serves to increase the dynamic range of the permeameter over a wide range of permeabilities.

The preferred pressure transducer 172 provides an analog voltage output signal which varies in amplitude in accordance with the pressure within the main cylindrical body 136. The transducer should be capable of operating up to 50 psia. Many suitable pressure transducers are available on the market today and provide a 0 to 5 volt analog output signal for a 0 to 50 psia range.

The output from the pressure transducer 172 is connected to the input of an analog-to-digital converter (A/D) 174 which provides a digital output signal in response to the analog output signal from the pressure transducer 172. The A/D converter 174 is preferably a 12-bit device.

The digital outputs from the A/D converter 174 are directed to a microprocessor or mini-computer 176 for storage and manipulation of the data.

Because the sample tested with the clay pycnometer is no longer usable and must be discarded, a new coarse fragment of the original sample, which was heated in the oven to remove its volatiles, should be used for this test. The size of the sample is preferably between 0.1 and 0.9 cc.

The sample 178 to be measured is encapsulated in an epoxy mount 180 which is preferably cylindrically shaped to resemble a pill. Mounting the sample in the epoxy must be done carefully. Approximately three minutes after the epoxy is mixed, it is applied to the sample to fully encapsulate it. The reason for waiting three minutes is to allow the epoxy to sufficiently set so that it will not intrude into the pores of the sample.

Furthermore, the samples should not be mounted in the epoxy much longer than three minutes after it has been mixed. Otherwise, the epoxy may have cured to a point where it is so solid that an insufficient bond is made between the epoxy and the sample.

After the sample 178 has been encapsulated in the epoxy mount 180, the epoxy should be given enough time to cure before proceeding with further preparation of the mount. In most cases, the epoxy will have sufficiently cured within about 45 minutes after it has been mixed depending on the particular curing properties of the epoxy used.

At this point, an upper bore 182 and a lower bore 184 are formed in the epoxy mount 180 and respectively extend from the upper surface 186 and the lower surface 188 thereof. The bores 182, 184 should be in axial alignment and should extend partially into the sample itself encapsulated by the epoxy.

A flat bottom drill is preferably used to form the bores 182, 184 in the epoxy mount 180. Preferably, a silicon carbide drill bit is used to ensure that uniformly cylindrical bores are formed. In this way, the diameter of the bores can be precisely determined. It is important at this point to also measure by any conventional means including a venier caliper arrangement the thickness of the sample 178 between the upper and lower bores.

The epoxy mount 180 is then placed on the O-ring 158 of the sample support member 140. The O-ring 158, preferably being a soft rubber material, and the epoxy of the mount form an air-tight seal. Vacuum grease may be used to assure a good seal. The epoxy mount 180 should be positioned on the O-ring 158 of the sample support member with its bores 182, 184 in alignment with the bore 152 formed in the sample support member 140.

As is evident from the structure of the permeameter of the present invention described above, the vacuum pump 170 creates a pressure differential across the sample 178 encapsulated in the epoxy mount 180. One side of the sample is at atmospheric pressure while the other side facing the support member 140 is at a lower pressure. The pressure within the main cylindrical body 136 of the permeameter is measured by the transducer 172, converted to a corresponding digital data word by the A/D converter 174 and processed and stored by the microprocessor or mini-computer 176.

The permeameter works in accordance with the principles of Darcy's law, as follows:

$$K = \frac{2uQL}{A(p_1^2 - p_2^2)} \quad \text{(Eq. 13)}$$

where $p_1$=one atmosphere pressure on one side of the sample, $p_2$=0 to 1 atmosphere pressure measured in the main cylindrical body A=the cross sectional area of the bores formed in the epoxy mount and the sample u=the viscosity of air which equals 0.0167 cp t=time in seconds K=the permeability in Darcies L=the thickness of the sample measured between the two bores of the mount Q=the volume flow rate of the air through the sample.

Many conventional permeameters measure the flow rate, Q, of the air through the sample to determine its permeability. The permeameter of the present invention measures the differential change in pressure within the main cylindrical body 136 of the permeameter. From Equation 13 above, the operating equation of the permeameter of the present invention is derived as follows:

$$\text{since } Q = \frac{\Delta V_1}{\Delta t}$$

$$\text{and } \frac{P_1 \Delta V}{\Delta t} = V_2 \cdot \frac{\Delta P_2}{\Delta t}$$

where $V_2$=the volume of the vacuum apparatus in $cm^3$, and $\Delta V_1/\Delta t$=volume rate of flow at $P_1$ into the sample, it follows that $$K = \frac{2uL}{A \cdot (P_1^2 - P_2^2)} \cdot \frac{V_2}{P_1} \cdot \frac{P_2}{\Delta t}$$

Let $$C = \frac{P_1 A}{2uLV_2},$$

all of which are known quantities.

$$\text{Then } \frac{dP_2}{dt} = CK(1 - P_2^2) \quad \text{(Eq. 14)}$$

Equation 14 becomes the operating equation of the permeameter.

The microprocessor or mini-computer 176 is used to automatically record the differential change in pressure within the permeameter over time. Many conventional permeameters do a single point measurement to determine the permeability of a cutting. The permeameter of the present invention with its associated mini-computer 176 provides a dynamic analysis of the data from the A/D converter 174 and, through a least squares fitting of the resultant data, provides a more accurate measurement of the permeability.

Figure 8:
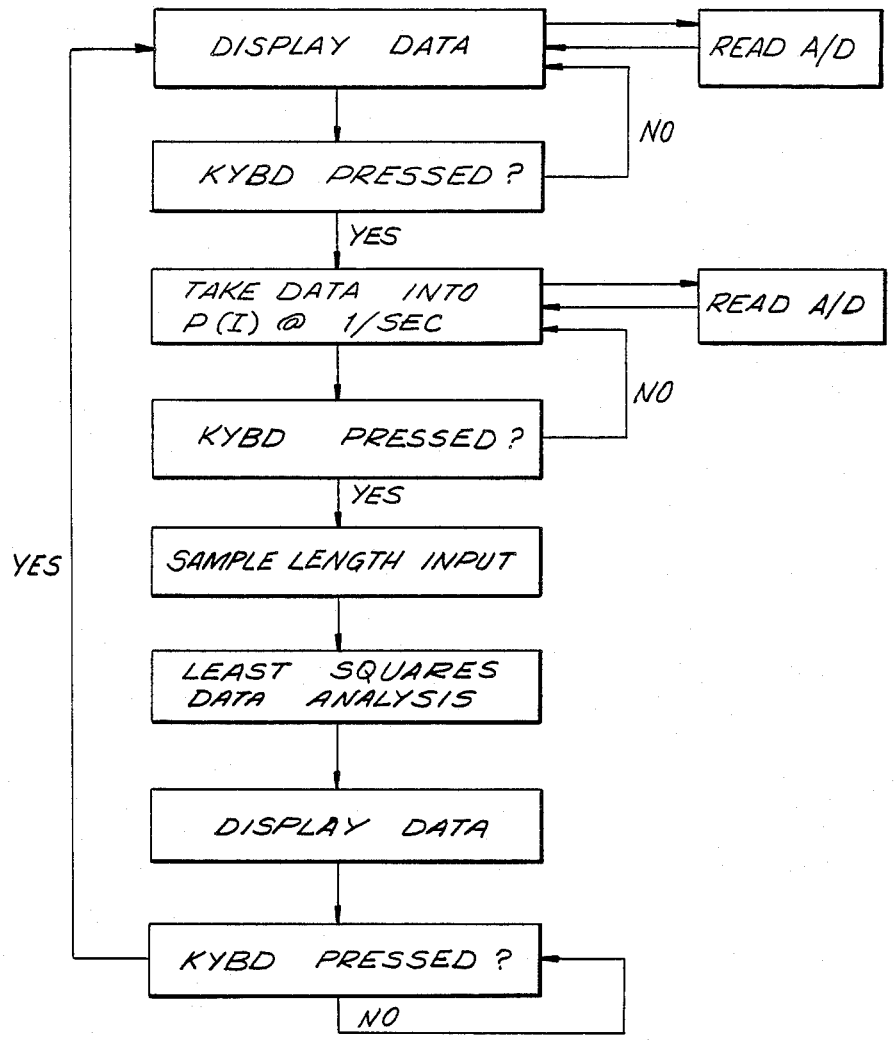
FIG. 8 is a flow chart of a computer program for a computer used in association with the permeameter of the present invention shown in FIG. 7.

We refer you to FIG. 8 of the drawings for a flow chart of a program for the mini-computer.

As shown in the flow chart of FIG. 8, data is read from the A/D converter 174 when a keyboard button on the computer is depressed. This data is also displayed. The operator depresses the keyboard button when the sample is properly mounted on the permeameter and ready for testing. Data is then automatically read by the mini-computer from the A/D converter a predetermined number of times at a selected interval, for instance, every one second. Alternatively, the mini-computer can continually read the data at preselected intervals until a second keyboard button is depressed, as shown in the flow chart. Depressing the second keyboard button will terminate the previous data entry step.

At this point, the mini-computer waits until the thickness, L, of the particular sample under test is fed into the computer. The thickness, L, is the only parameter which will vary from sample to sample; all other parameters, i.e., $p_1$, A, u and $V_2$, each of which was defined earlier, remain constant for different samples.

The mini-computer 176 performs a polynomial least squares analysis on the data. The least squares analysis approximates the curve of pressure data points and provides an accurate determination of the permeability of the sample. The permeability is then displayed by the mini-computer with a correlation coefficient which is indicative of how close the approximation of the data is to the true curve.

A keyboard button may then be depressed to signal the minicomputer to prepare for the next sample.

An example of a measurement using the permeameter of the present invention is shown below. A sample was encapsulated in an epoxy mount and, after upper and lower bores were formed in the mount, was measured to have a thickness between the bores of 1.4 mm. The mount was placed on the permeameter and the sample was tested. Table I, provided below, shows the digital equivalents of the readings from the A/D converter and the time each reading was taken.

TABLE I

| A/D Reading | Time (Sec) |
|---|---|
| 29 | 0 |
| 156 | 1 |
| 285 | 2 |
| 407 | 3 |
| 520 | 4 |
| 624 | 5 |
| 718 | 6 |
| 802 | 7 |
| 874 | 8 |
| 936 | 9 |
| 988 | 10 |
| 1030 | 11 |

The main cylindrical body of the permeameter used to test the sample had a volume, $V_2$, equal to 30 $cm^3$. The diameter of the bore formed in the sample support member was 4 mm. The upper and lower bores formed in the epoxy mount were 2 mm in diameter.

Using a least squares analysis, the mini-computer calculated the permeability of the sample to be 575 mD. The correlation coefficient for this measurement was 0.9997, which indicates that the least squares approximation closely fitted the data curve.

According to the process of the present invention, a medium size fragment of the sample of the cutting is tested with a spectrometer. As previously mentioned, the medium sized fragment was not placed in the oven with the large size fragments. For this reason, it contains all of its minerals including the heavy hydrocarbons. Thus, a complete mineral analysis is obtainable.

It is well known in analyzing oil well cuttings to use infrared spectroscopy to obtain the mineral content of the cuttings. Basically, samples of the cuttings are ground to a fine powder and examined with a spectrometer. The mineral constituents of the cuttings are identified by comparing their spectra with the spectra of pure minerals. Quantitative analysis can be made for minerals which have sharp, well-defined adsorption bands such as quartz, kaolinite, orthoclase, calcite and dolomite.

It is important to grind the mineral samples to a particle size smaller than the wavelength of the infrared radiation. The presence of large particles tends to scatter the radiation so that only a small percentage of the incident radiation is transmitted and the absorption bands are distorted.

According to the process of the present invention, some of the medium-size grained particles separated during the sieving step are ground to a mean particle size of less than about 5 um and mixed with potassium bromide (KBr). The mixture is subjected to a high pressure pellet press whereby a translucent KBr pellet of the material is formed. Any cloudy pellets should be remade. KBr pellets are used because they are most free of spectral artifacts.

The KBr pellet is subjected to spectroscopic analysis using an FTIR (Fourier transform infrared) spectrometer.

An FTIR instrument is preferred because it theoretically is more accurate and gives more consistent results than conventional dispersive spectrometers. The present invention invisions the use of a mini-computer or microprocessor for storage and manipulation of the data from the FTIR spectrometer and to generally aid in the mineral analysis of the cutting. By using a computer, the sample can be analyzed for its mineral constituents in less than two minutes.

An optional step in the process of the present invention is to determine the pore spectrum of the cutting, if such is desired. This may be done with a conventional porosimeter which, because it is well known in the art, will not be described herein.

An example of an analysis of a cutting in accordance with the process of the present invention is described below. Samples were taken from a cutting from an oil well at a depth of between 440 and 450 feet.

A sample of the cutting was first analyzed to determine its water and hydrocarbon content. The weight of the sample holder, that is, the lower segment of the device, and the textile seal was 22.997 grams. The initial weight of the sample holder, seal and the sample was 37.056 grams. The weight of the upper segment of the device with the molecular sieves was initially measured to be 58.153 grams.

After the test was performed, the final weight of the sample holder, seal and the sample was 37.023 grams whereas the final weight of the sieves and the sieve holder was 58.186 grams. From the above measurements, it was found that the sample contained only a negligible amount of light hydrocarbons. The water content was measured to be 0.033 grams, or 0.69% of the sample.

According to the process of the present invention the sample of the cutting is then divided by sieving into three groups of particles, i.e., fine, medium grain and coarse grain particles. The fine particles were weighed as being 9.237 grams and were discarded. The weight of the medium sized grain particles was 3.170 grams. The weight of the course grain particles was 1.577 grams.

The course grain particles were then placed in an oven at a temperature of 250° C. for one hour. They were removed and reweighed. The weight of the course grain particles was measured to be 1.576 grams. The weight of the heavy hydrocarbons was thus determined to be 0.001 grams, or 0.06% of the coarse sample.

The helium pycnometer was then used to test one of the coarse grain particles, after they were removed from the oven, to determine the grain density of the cutting. The coarse grain particle used was previously weighed as 1.577 grams. The coarse grain particle was then placed in the sample chamber of the helium pycnometer and tested. Before expansion, the pressure in the auxiliary chamber was measured to be 2762, expressed as a reading from the A/D converter in digital form. After expansion, the pressure in the auxiliary chamber was measured to be 1712. The volumes of the sample and auxiliary chambers were calibrated as 4.797 cc and 2.589 cc respectively. From the calibration and test data, the grain volume of the sample was measured to be 0.575 cc. From this measurement and knowing that the weight of the coarse sample is 1.577 grams, the grain density was calculated to be 2.743 grams per cubic centimeter.

Another coarse grain particle, after being removed from the oven, was tested in the clay pycnometer of the present invention to determine the bulk volume and the bulk density of the cutting.

The weight of the sample was measured to be 0.560 grams. The sample was placed into the bore of the cylindrical extruder and the extruder was twice inserted into the reservoir of the base until clay surrounded the sample and filled the remaining space of the bore. After shaving off excess clay, the total weight of the cylindrical extruder, with its bore filled with clay and the sample, was measured to be 56.701 grams. The weight of the sample was subtracted from the combined weight of the cylindrical extruder, clay and sample to yield a figure of 56.141 grams. The cylindrical extruder of the clay pycnometer with its bore completely filled with clay (without a sample) was calibrated to be 56.482 grams. The density of the clay was also determined previously during calibration as being 1.649 grams per cubic centimeter. By subtracting the weight of the cylindrical extruder filled with clay from the weight of the cylindrical extruder with the clay only partially filling its bore, i.e., 56.482–56.141, and by dividing this number by the known density of the clay, i.e., 1.649 grams per cubic centimeter, the grain volume of the sample was determined to be 0.2068 cubic centimeters. The bulk density of the cutting, which equals the weight of the sample divided by the grain volume, that is, 0.560 divided by 0.2068, was determined to be 2.708 grams per cubic centimeter.

The porosity of the cutting can now be determined from the above calculations. As stated previously, the porosity is determined by dividing the bulk density by the grain density, subtracting from one (1) and multiplying by 100. This was calculated to be 1.2%.

Because the porosity was less than 7%, a permeability test on the sample would not provide any usable information and was not performed.

Using an FTIR spectrometer and testing a medium size particle ground and mixed with potassium bromide (KBr) to form a translucent pellet yielded the mineral content of the sample, expressed in % weight, as shown in the following table:

TABLE II

| Mineral analysis of sample taken from a depth of between 440–450 feet. | |
|---|---|
| Mineral | % Weight |
| Quartz | 0 |
| Kaolinite | 0 |
| Montmorillonite | 35 |
| Dolomite | 7 |
| Calcite | 58 |
| Gypsum | 0 |
| Anhydrite | 0 |

The process and apparatus described herein is perfectly adaptable for testing samples of oil or gas well cuttings in batch in a relatively short period of time. With the help of the mini-computer, a complete analysis of a large batch of cuttings can take 24 hours or less. The equipment required for the analysis can be set up in a laboratory or transported in a van or light truck to the job site. The samples tested are relatively small and can be quickly analyzed so that the geologist can make immediate, on-the-job decisions based upon his findings.

Although illustrative embodiments of the invention have been described herein with reference to the accompanying drawings, it is to be understood that the invention is not limited to those precise embodiments, and that various other changes and modifications may be effected therein by one skilled in the art without departing from the scope or spirit of this invention.

What is claimed is:

1. A process for measuring the water and light hydrocarbon content of a sample of known weight of a cutting from an oil or gas well, which comprises the steps of heating the sample to about between 105° and 110° C. to volatilize substantially all of the water and light hydrocarbon molecules contained in the sample, passing the volatilized water and light hydrocarbon molecules through a plurality of molecular sieves having an initially known weight and having pore sizes selected to separate substantially all of the volatilized water molecules from the volatilized light hydrocarbon molecules and to retain substantially all of the volatilized water molecules, weighing the sample after substantially all of the water and light hydrocarbon molecules contained therein have been volatilized and weighing the molecular sieves after substantially all of the water molecules volatilized from the sample have been retained thereby.

2. A process as defined in claim 1 wherein the plurality of molecular sieves are maintained at a temperature sufficiently low enough to allow the volatilized water molecules to condense thereon and be absorbed thereby.

3. A process as defined in claim 2 wherein the plurality of molecular sieves are maintained at a temperature of between about 80° and 85° C.

4. A process for measuring the water and hydrocarbon content of a sample of a cutting from an oil or gas well, which comprises the steps of weighing the sample, heating the sample to volatilize water and hydrocarbon molecules contained therein while concurrently exposing the sample to a flow of gas to carry from the sample the volatilized water and hydrocarbon molecules given off by the sample, passing the gas carrying the volatilized water and hydrocarbon molecules through a molecular sieve of an initially known weight to separate the water molecules from the hydrocarbon molecules and to retain the water molecules, reweighing the sample after the water and hydrocarbon molecules have been volatilized and weighing the molecular sieve retaining the water molecules.

5. A process for analyzing cuttings from oil and gas wells, which comprises the steps of:

heating a sample of known weight of a cutting from the oil or gas well to about between 105° and 110° C. to volatilize substantially all of the water and light hydrocarbon molecules contained in the sample;

passing the volatilized water and light hydrocarbon molecules through a plurality of type 3A molecular sieves having an initially known weight to separate substantially all of the volatilized water molecules from the volatilized light hydrocarbon molecules wherein substantially all of the volatilized water molecules are retained by the molecular sieves;

weighing the sample after substantially all of the water and light hydrocarbon molecules contained therein have been volatilized and weighing the molecular sieves after substantially all of the water molecules volatilized from the sample have been retained thereby;

heating the sample to between about 250° and 275° C. under a vacuum to remove substantially all of the heavy hydrocarbon molecules contained therein;

weighing the sample after it has been heated to about between 250° to 275° C. to determine the heavy hydrocarbon content of the sample;

placing the sample in a Boyle's Law pycnometer having a sample chamber to contain the sample and an auxiliary chamber, the chambers being interconnected through an expansion valve, the sample chamber also being connected to a controllable source of pressurized gas;

initializing the pressure in both the sample and auxiliary chambers to atmospheric;

increasing the pressure in the sample chamber;

equalizing the pressures in the sample and auxiliary chambers by expanding into the auxiliary chamber;

increasing the pressure in the sample chamber while returning the pressure in the auxiliary chamber to atmospheric;

monitoring the pressure in the sample chamber;

equalizing the pressures in the sample chamber and the auxiliary chamber by expanding into the auxiliary chamber;

monitoring the pressure in the sample chamber, wherein the grain density in the cutting is determined from the following equation:

$$G_d = \frac{w}{V_a - V_c\left(\frac{P2}{P3} - 1\right)}$$

wherein $G_d$ is the grain density of the cutting, w is the weight of the sample, $V_a$ is the volume of the auxiliary chamber, $V_c$ is the volume of the sample chamber, P2 is the pressure of the sample chamber before the second expansion step, and P3 is the pressure in one of the sample and auxiliary chambers after the second expansion step; and extruding a measurable amount of a nonwetting fluid through a third chamber of determinable volume containing the sample having a known weight so that the fluid and the sample occupy the entire volume of the third chamber, wherein the bulk density of the cutting may be determined from the weight of the sample divided by the difference between the volume of the third chamber and the volume of the fluid extruded into the third chamber.

6. A process as defined in claim 5 wherein the sample is further tested to determine its permeability by using a permeameter, the permeameter including a main cylindrical body having open upper and lower ends and a central bore extending axially therethrough between the upper and lower ends, the lower end of the main cylindrical body being connected to a source of vacuum; a sample support member having upper and lower ends, the lower end of the sample support member being received by the upper end of the main cylindrical body, the sample support member having a top surface and a bottom surface and having formed therein between the top and bottom surfaces thereof a central bore, the sample support member including a recess formed in the top surface thereof which surrounds an opening of the bore formed in the top surface, the support member including an O-ring which is partially fitted into the recess formed in the top surface; a pressure transducer for measuring the pressure within the main cylindrical body, the pressure transducer producing an analog output voltage signal which varies in amplitude in accordance with the pressure within the main cylindrical body; means for mounting the sample of the cutting adjacent the O-ring of the sample support member, the sample mounting means including an epoxy body surrounding the sample, the sample mounting means having an upper surface and a lower surface and having formed therein an upper bore and a lower bore extending respectively from the upper surface and the lower surface thereof partially into the sample to be tested, the upper bore and the lower bore being in axial alignment, the lower surface of the epoxy mount being removably mounted on the O-ring of the sample support member and forming an airtight seal therewith, the upper and lower bores of the epoxy mount being in axial alignment with the central bore formed in the sample support member; an analog-to-digital converter connected to the output of the pressure transducer, the analog-to-digital converter generating a digital output signal in response to the analog output signal of the pressure transducer; and a microcomputer connected to the output of the analog-to-digital converter for storage and manipulation of the digital data from the analog-to-digital converter, the process further comprising the steps of:

measuring the differential change in pressure in the central bore of the main cylindrical body over a predetermined length of time and using the following equation to determine a permeability curve for the sample:

$$dP_2/dt = C \cdot K \cdot (1 - P_2^2)$$

where $C$ equals $\frac{P_1 A}{2uLV_2}$ where $p_1$=one atmosphere pressure on one side of the sample, $p_2$=0 to 1 atmosphere pressure measured in the main cylindrical body, A=the cross sectional area of the bores formed in the epoxy mount and the sample, u=the viscosity of air which equals 0.0167 cp, t=time in seconds, K=the permeability in Darcies, L=the thickness of the sample measured between the two bores of the mount, and $V_2$=the volume of the vacuum apparatus in $cm^3$; and using a least squares approximation of the permeability curve to determine the permeability of the sample.

7. A process as defined in claim 5 which further comprises the steps of:

grinding the sample to a mean particle size of less than about 5 $\mu$;

mixing the ground particles with potassium bromide;

subjecting the mixture to a high pressure pellet press to form a translucent pellet; and subjecting the pellet to spectroscopic analysis using a Fourier transform infrared spectrometer.

8. A process as defined in claim 5 which further comprises the step of determining the pore spectrum of the cutting by testing the sample with a porosymeter.

* * * * *